US008066145B1

(12) United States Patent
Durbin et al.

(10) Patent No.: US 8,066,145 B1
(45) Date of Patent: Nov. 29, 2011

(54) FOOD SERVING UNIT

(76) Inventors: Cheryl Durbin, Fremont, OH (US); David H. Durbin, Fremont, OH (US)

( * ) Notice: Subject to any disclaimer, the term of this patent is extended or adjusted under 35 U.S.C. 154(b) by 165 days.

(21) Appl. No.: 12/470,082

(22) Filed: May 21, 2009

Related U.S. Application Data

(60) Provisional application No. 61/055,960, filed on May 23, 2008.

(51) Int. Cl.
*B65D 1/34* (2006.01)
*B65D 21/02* (2006.01)
*A47G 19/00* (2006.01)

(52) U.S. Cl. ..... 220/571; 220/23.89; 220/574.3

(58) Field of Classification Search ..... 220/571, 220/573.1, 573.4, 574.3, 915.1, 915.2
See application file for complete search history.

(56) References Cited

U.S. PATENT DOCUMENTS 2,716,508 A * 8/1955 Booth ..... 222/131
4,162,029 A * 7/1979 Gottsegen et al. ..... 222/131
5,064,088 A * 11/1991 Steffes ..... 220/837
5,730,282 A * 3/1998 Bureau ..... 206/223

* cited by examiner

*Primary Examiner* — Harry Grosso
(74) *Attorney, Agent, or Firm* — Jerry Semer

(57) ABSTRACT

The invention is a device that is designed to keep foods placed within it cold and the bugs away. The invention has a tub made out of a double layer of plastic. The tub has a drain in the bottom so water from melting ice can be drained off. The double walled construction is design to allow the tub to sit on a flat surface but still allow liquid to be removed by the drain. The tub also contains indentions in the bottom for the placement of the top tubes of a stand. On top of the tub is placed a covering that makes a quarter circle and covers the top. The covering is attached to the tub and stays in place when the tub is in use. The covering can be rotated for use.

9 Claims, 6 Drawing Sheets

FOOD SERVING UNIT

FIELD OF INVENTION

This invention relates to the field of food serving units for parties and more particularly to the field of food serving units for parties that occur outside.

BACKGROUND OF THE INVENTION

Whenever one is thinking of a party outdoors or in an open area, there are two main problems that come to mind. The first being, how to keep the food that is to be served cold and the second is how to keep the insects away. Applicant has devised an invention that has solved both of these problems. The feature that allows the invention to solve these problems is applicant has developed a plastic molded tub that is designed to fit upon a stand or table top. Within this tub an individual can place the food. The tub is designed for ice to cool the food. The tub has a drain to drain away excess water from the ice.

Further, the additional feature that makes this tub efficient at keeping the bugs away and keeping the cold in is a cover. This cover is designed so it can be easily opened and closed, and for easy access to the food. The cover is designed in a semicircular manner in which the front half or the back half of the semicircle can be pulled back to open up the food for serving. Thus half of the covering remains in place to keep the food cold while serving and to keep the bugs away. The additional feature that makes serving easy from the tub is a stand on which it fits so it sets at about waist high.

The tub is made out of molded plastic to make it economical to produce.

SUMMARY OF THE INVENTION

The invention is a device that is designed to keep foods placed within it cold and keep the bugs away. The invention has a tub in the preferred embodiment made out of a double layer of plastic. The tub has a drain in the bottom so water from melting ice can be drained off. The tub is of sufficient size that ice can be placed within for cooling. The bottom of the tub is not made completely flat. It is angled downward towards the drain. The tub also contains indentions in the bottom for the placement of the top tubes of a stand. The stand is comprised of two inverted U shaped tubes that are attached together in the middle of the legs. Thus, the tubes can be pulled apart and placed underneath the tub enabling the tub to stand at about waist high. The two top tubes fit within the indentions in the bottom of the tub. On top of the tub is placed a covering that makes a quarter circle and covers half the top. The covering is attached to the tub and the preferred embodiment stays in place when the tub is in use. Also attached to the tub is a second covering that forms another quarter circle and covers the rest of the top. Along the front of the rotary top is a ridge so that it can be lifted. The quarter circular rotary top is attached to the tub with a rotary attachment such that an individual can, lift the top and rotate it to have access to the food inside within the tub.

DETAILED DESCRIPTION OF THE PREFERRED EMBODIMENT

Figure 1C:
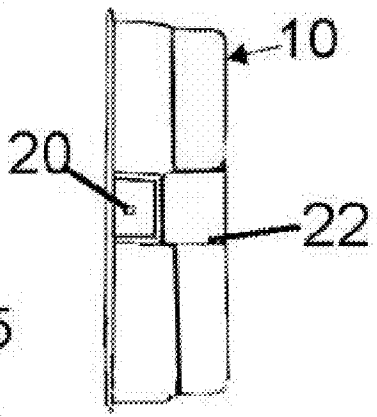
FIG. 1*c* is a side view of the outer tub.
Figure 1A:
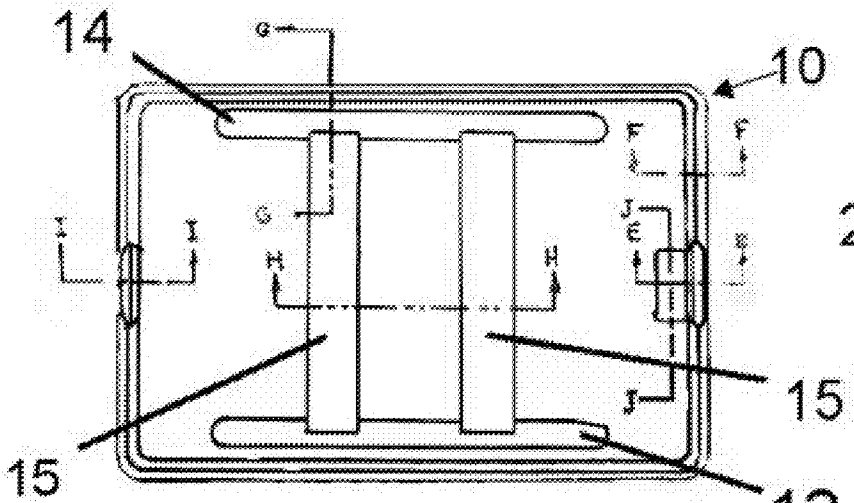
FIG. 1*a* is a top view of the outer tub.
Figure 1B:
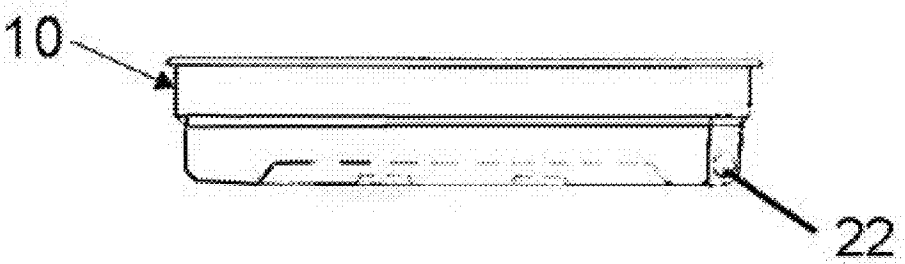
FIG. 1*b* is a front view of the outer tub.

The first figures are views of the outer tub 10. FIG. 1*a* is a view of the bottom outer tub 10. FIG. 1*b* is a front view of the outer tub 10. FIG. 1*c* is a side view of the outer tub 10. In the preferred embodiment the outer tub 10 is made out of molded plastic. On the bottom of the 10 tub lengthwise are two concave indentions 12 and 14 running lengthwise along the bottom of the outer tub 10. These indentions 12 and 14 on the bottom of the outer tub 10 form a concave surface into which the top tubes 62 of the stand 50 shown in FIGS. 6 and 7. Also on the bottom of the outer tub 10 are two other concave surfaces for reinforcement. These reinforcements 15 run width wise between the two concave indentions 12 and 14. The side view shows two openings, the hinge opening 20 and the spigot opening 22, both placed in the middle of the side of outer tub 10. The hinge opening 20 at the top in the middle of the outer tub 10 and the spigot opening 22 at the bottom of the outer tub 10. A bolt 34 passes through the hinge opening 20 and forms the hinge that allows the first and second revolving cover 36 and 38 to be opened. The spigot opening 22 is designed to drain any excess water when ice is used to cool the food in the invention.

Figures 2A, 2B, 2C:
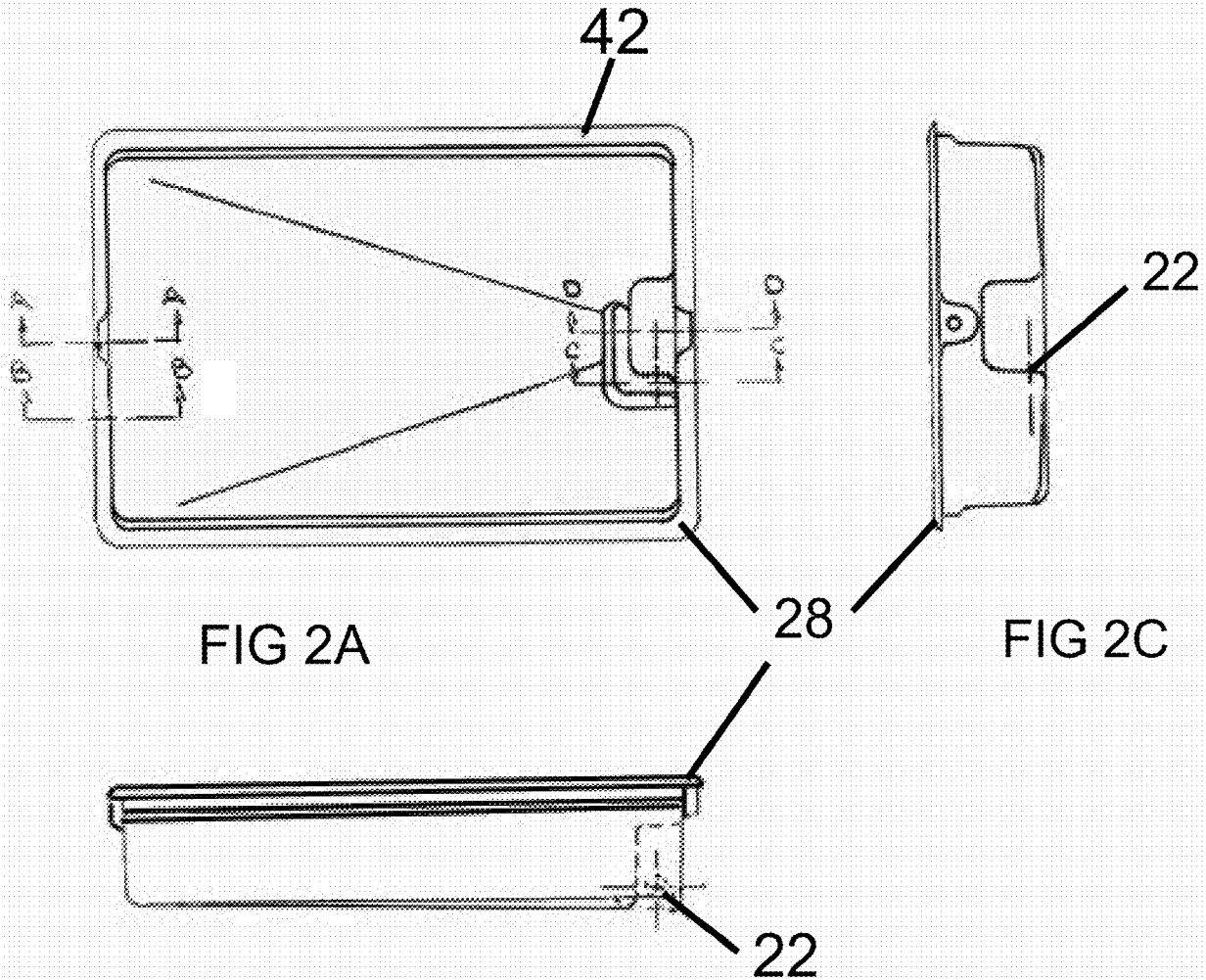
FIG. 2*a* is a top view of the inner tub.
FIG. 2*b* is a front view of the inner tub.
FIG. 2*c* is a side view of the inner tub.

FIG. 2 shows the inner tub 28. FIG. 2*a* is a top view of the inner tub 28. FIG. 2*b* is a front view of the inner tub 28 and FIG. 2*c* is a side view of the inner tub 28 on side in which the spigot 30 is placed. FIGS. 2*a* and 2*b* show that the inner tub's 28 bottom is slightly tilted toward the spigot 30 so that if liquids are placed within the tub or ice, the liquid would run toward the spigot 30. FIG. 2*c* shows spigot opening 22 for the spigot 30. The inner tube 28 is designed to fit within the outer tub 10.

Figure 3A:
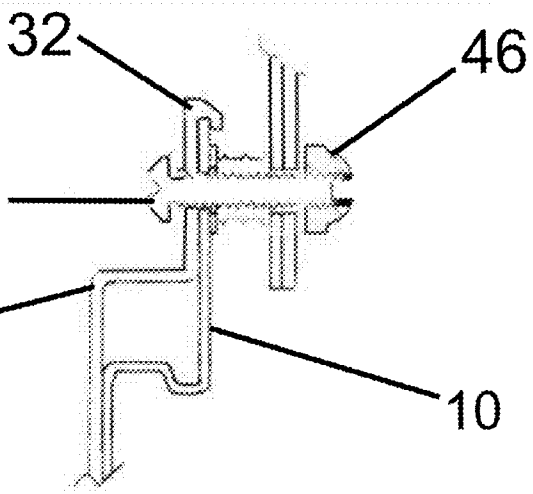
FIG. 3A is a cut away view along line E-E and D-D of both the inner tub 28 and the outer tub 10 being placed together on the spigot end.
Figure 3B:
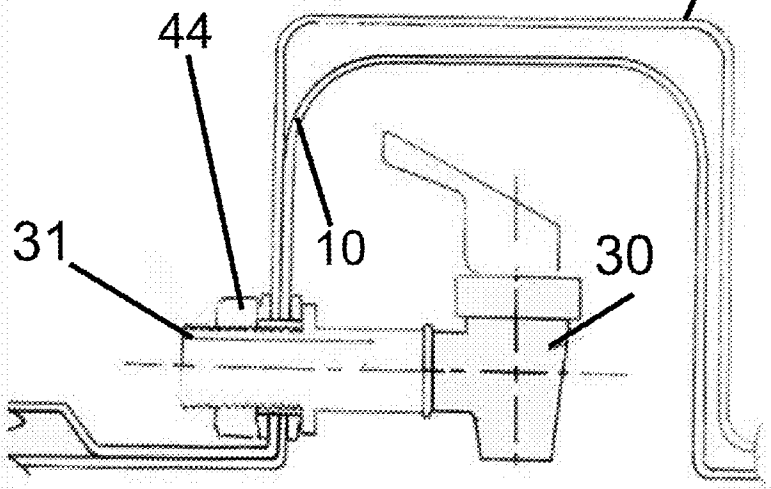
FIG. 3B is a cut away view along line J-J of both the inner tub 28 and the outer tub 10 being placed together on the spigot end.

FIG. 3A is a cut away view along lines E-E and D-D of both the inner tub 28 and the outer tub 10 being placed together on the spigot 30 end. FIGS. 3A and 3B shows the inner tub 28 and the outer tub 10. FIG. 3A shows that the inner tub 28 is hooked over the outer tub 10 at the top. This area of hooking over 32 of the outer tub 10 extends all the way around the outer tub 10. FIG. 3B also shows the spigot 30 attached to the inner tub 28 and outer tub 10. Spigot 30 has a threaded end 31. The threaded end 31 is passed through the inner tub 28 and outer tub 10 through opening 22. The Spigot is held in place by coupling 44 which is threaded on the threaded end 31. The spigot 30 is designed to carry off liquids that form in the bottom of the inner tub 28 when ice is placed in the inner tub 28 and melts. When this occurs, as put forth above, the inner tub 28 is slightly inclined down toward the spigot 30 and the liquids flow out of the spigot 30 to empty when the ice melts.

At the top of the inner outer tub 28 is hinge opening 20. A bolt 34 passes through the hinge opening 20 in both the inner tub 28 and outer tub 10. This bolt 34 is designed to fasten the first and second rotating cover 36 and 38, the inner tub 28 and the outer tub 10 as shown in FIGS. 4 and 6.

Figure 4:
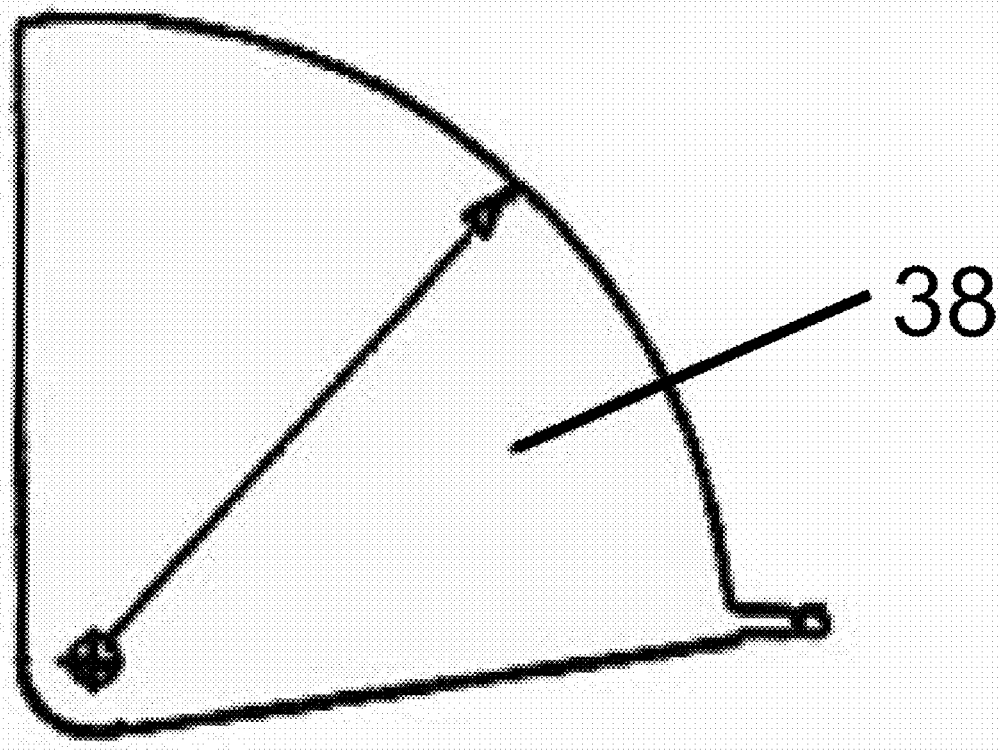
FIG. 4 is a side view of the stationary cover.
Figure 5:
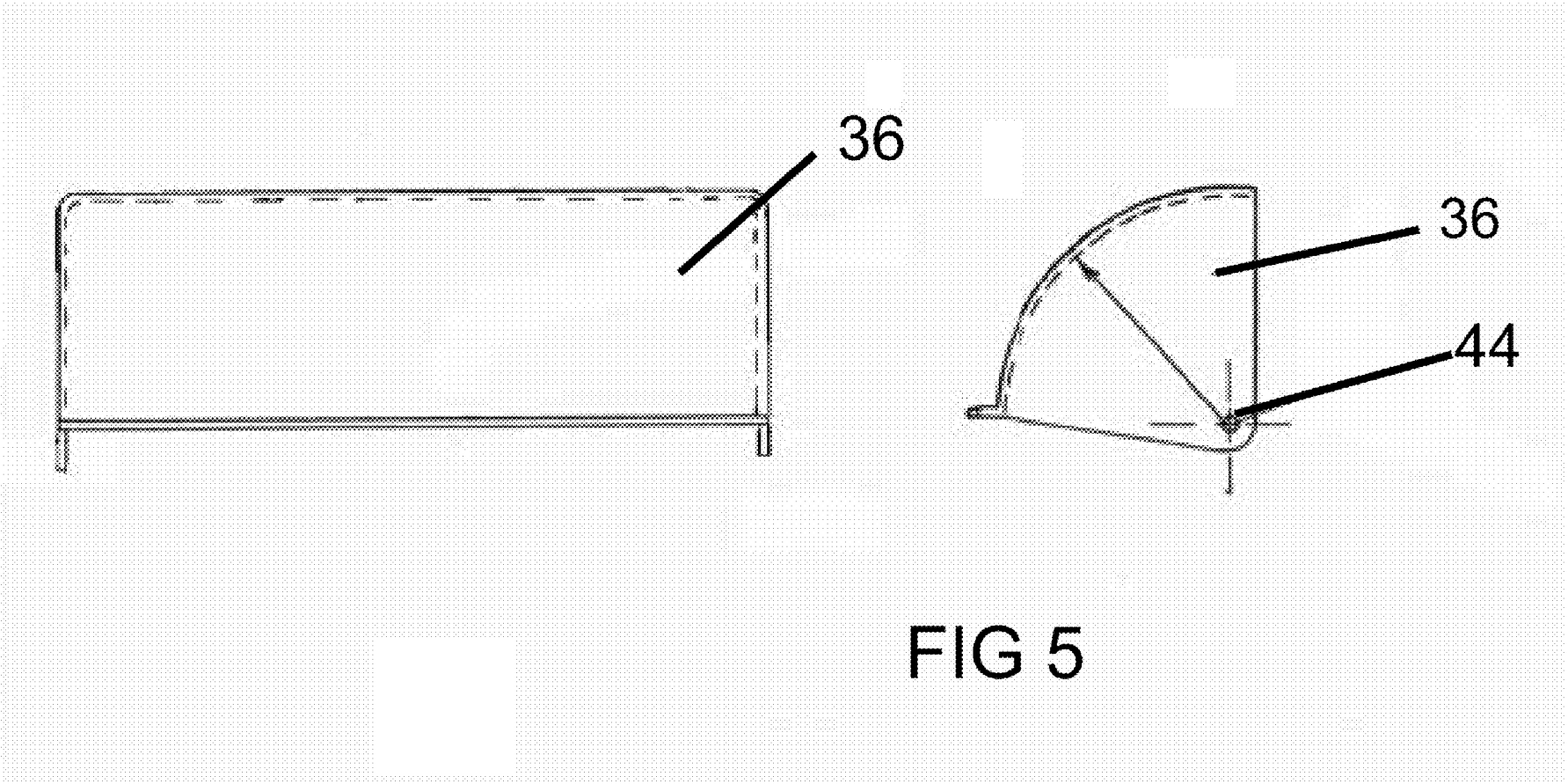
FIG. 5 is two views of the rotating cover.
Figure 7:
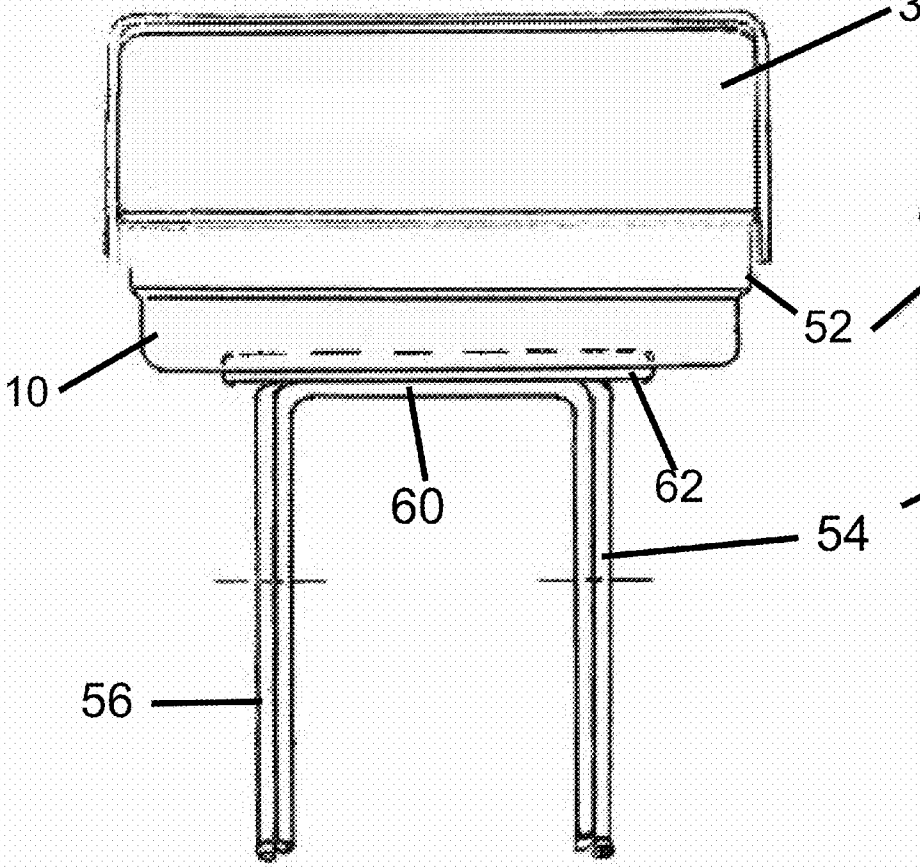
FIG. 7 is a front view of the food serving unit on the stand.

FIG. 4 shows a side view of the second rotating cover 38. This second rotating cover's 38 shape is semi-circular and makes up approximately a quarter of the circle. The second rotating cover 38 is designed to rotate and set upon the ledge 42 formed by the inner tub 28 shown in FIG. 5. This FIG. 5 shows the second rotating cover 38 sitting on the inner and outer tubs 10 and 28. This second rotating cover 38 covers only one half of the inner and outer tubs 28 and 10 and is semi-circular in nature. This allows room for easy access to the food within the inner and outer tubs 28 and 10. The first rotating cover 36 shown in FIG. 5 fits under the second rotating cover 38. The first rotating cover 36 is also semi circular in shape and is slightly smaller than the second rotating cover 38. The first rotating cover 36 is shorter than the second rotating cover 38 and also longer than the inner tub 28 and outer tub 10. This is shown in FIG. 7. The first and second rotating covers 36 and 38 are attached to the inner tub 28 and outer tub 10 by bolt 34. Bolt 34 passes through the inner tub 28 and outer tub 10 and through the openings 45 in the first and second rotating covers 36 and 38 at both ends of the first and second rotating covers 38. Over bolt 34 is placed nut 46 which is tightened sufficiently to hold the first and second rotating covers 36 and 38 but not to interfere with the rotation of the first and second rotating covers 36 and 38. The rotating covers 36 and 38 easily rotate around bolt 34. The rotating cover 36 and 38 are designed to be longer than the inner tub 28 and outer tub 10. The first and second rotating cover 36 and 38 rest on the rotating cover ledge 48 at the back of the first and second rotating cover 38. The back of the first and second rotating cover 36 and 38, rests on ledge 42 formed by the inner tub 28. FIG. 7 shows how the rotating cover 36 and 38 closes the combination of inner tub 28 and outer tub 10.

Figure 6:
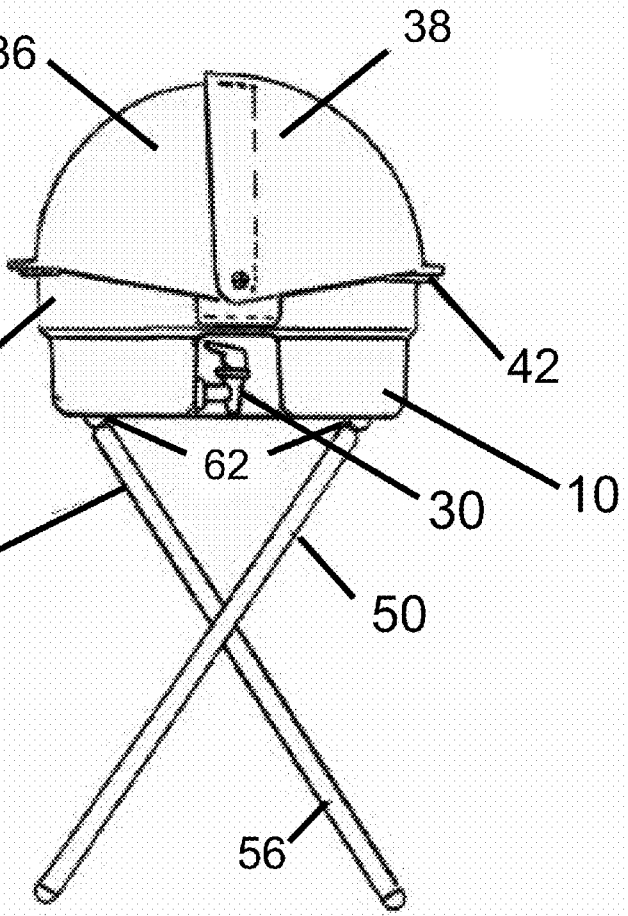
FIG. 6 is a side view of the food serving unit on the stand.

FIG. 6 also shows the stand 50 on which the food serving unit 52 sits. The stand 50 is formed out of two U-shaped tubes 54 and 56. The two U-shaped tubes 54 and 56 are attached a portion of the way down the legs 58 of the U-shaped tubes 54 and 56. The each of the two top bars 60 are attached to an attachment pieces 62 which fit within the indentations 12 and 14 on the bottom of the outer tub 10. The food serving unit 52 upon the stand 50 is shown in FIG. 7.

We claim:

1. A food serving unit comprising:

a. a spigot with a coupling and a threaded end, b. a bottom tub with a bottom, sides and top made of plastic and designed to set on a table and the bottom tub has an opening near the bottom of the side that the threaded end of the spigot can pass through;

c. a second tub with a bottom, sides and top made of plastic and designed to set within the bottom tub and said second tub has an opening near the bottom of the side that the threaded end of the spigot can pass through and the second tub has a bottom that is slanted so that liquids in the second tub will flow towards the opening in the side;

d. a covering that covers the second tub that can be partially opened and when partially opened will allow access to items within the second tub and when closed will fully cover the second tub;

e. when the second tub is place within the bottom tub the opening in the bottom tub lines up with the opening in the second tub and the spigot thread end can be placed through the openings in the bottom of the side of the bottom and in the bottom of the side of the second tub and the coupling is threaded over the threaded end of the spigot to hold the spigot in place;

f. a stand upon which the bottom tub sits;

g. the stand comprises:

1. indentions formed in the bottom of the bottom tub;
2. four legs formed from 2 U-shaped tubes that are attached a portion down the legs and said attachment is rotatable
3. the 2 U-shaped tubes are rotated to form an X and the two top portions of the U-shaped tubes are placed in the indentions formed in the bottom of the bottom tub which forms a stand.

2. A food serving unit comprising:

a. a spigot with a coupling and a threaded end, b. a bottom tub with a bottom, sides and top made of plastic and designed to set on a table and the bottom tub has an opening near the bottom of the side that the threaded end of the spigot can pass through;

c. a second tub with a bottom, sides and top made of plastic and designed to set within the bottom tub and said second tub has an opening near the bottom of the side that the threaded end of the spigot can pass through and the second tub has a bottom that is slanted so that liquids in the second tub will flow towards the opening in the side;

d. a covering that covers the second tub that can be partially opened and when partially opened will allow access to items within the second tub and when closed will fully cover the second tub;

e. when the second tub is place within the bottom tub the opening in the bottom tub lines up with the opening in the second tub and the spigot thread end can be placed through the openings in the bottom of the side of the bottom and in the bottom of the side of the second tub and the coupling is threaded over the threaded end of the spigot to hold the spigot in placer;

f. the cover is semicircular in shape and is form by a first and second pieces, each piece being a quarter of a circle.

3. A food serving unit as in claim 2 wherein:

1. the first and second piece are semicircular in shape with each end enclosed with a triangular piece and at the apex of each triangular piece there is an opening.

4. A food serving unit as in claim 3 wherein:

a. the bottom tub has an opening on each side near the top;

b. the second tub has an opening on each side near the top.

5. A food serving unit as in claim 4 wherein:

a. the first piece is smaller than the second piece and can fit inside the second piece.

6. A food serving unit as in claim 5 wherein:

a. the first and second piece are rotatable.

7. A food serving unit as in claim 6 further comprising:

a. a bolt;

b. said bolt fits thorough the openings in the first and second pieces and the openings in the top of the sides of the bottom tub and the opening in the top of the sides of the second tub;

c. a nut that threads upon the bolt;

d. bolts are placed through the openings on both sides of the second and first piece and then through the openings on both sides of second and bottom tub and the nut is threaded on the bolt and the bolt and nut a sufficiently tighten to hold the pieces on the second and bottom tub but not tight enough to interfere with the rotating of the first and second pieces.

8. A food serving unit as in claim 7 further comprising:

a. a stand on which the food serving unit sits.

9. A food serving unit as in claim 8 wherein:

a. the stand comprises:

i. indentions formed in the bottom of the bottom tub;

ii. four legs formed from 2 U-shaped tubes that are attached a portion down the legs and said attachment is rotatable iii. the 2 U-shaped tubes are rotated to form an X and the two top portions of the U-shaped tubes are placed in the indentions formed in the bottom of the bottom tub which forms a stand.

* * * * *